US010342109B2

(12) United States Patent
Lai et al.

(10) Patent No.: US 10,342,109 B2
(45) Date of Patent: Jul. 2, 2019

(54) APPARATUS AND METHOD FOR GENERATING EXTREME ULTRAVIOLET RADIATION

(71) Applicant: TAIWAN SEMICONDUCTOR MANUFACTURING CO., LTD., Hsinchu (TW)

(72) Inventors: Wei-Chih Lai, Changhua County (TW); Han-Lung Chang, Kaohsiung (TW); Bo-Tsun Liu, Taipei (TW); Li-Jui Chen, Hsinchu (TW); Po-Chung Cheng, Chiayi County (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 0 days.

(21) Appl. No.: 15/906,574

(22) Filed: Feb. 27, 2018

(65) Prior Publication Data

US 2019/0150262 A1 May 16, 2019

Related U.S. Application Data

(60) Provisional application No. 62/585,778, filed on Nov. 14, 2017.

(51) Int. Cl.
*H05G 2/00* (2006.01)
*G21K 5/00* (2006.01)

(52) U.S. Cl.
CPC ..... *H05G 2/006* (2013.01); *H05G 2/008* (2013.01)

(58) Field of Classification Search
CPC ..... H05G 2/006; H05G 2/008
USPC ..... 250/493.1, 504 R
See application file for complete search history.

(56) References Cited

U.S. PATENT DOCUMENTS

| | | | |
|---|---|---|---|
| 7,164,144 | B2 | 1/2007 | Partlo et al. |
| 8,796,666 | B1 | 8/2014 | Huang et al. |
| 9,093,530 | B2 | 7/2015 | Huang et al. |
| 9,184,054 | B1 | 11/2015 | Huang et al. |

(Continued)

OTHER PUBLICATIONS

Toshihisa Tomie, "Tin laser-produced plasma as the light source for extreme ultraviolet lithography high-volume manufacturing: history, ideal plasma, present status, and prospects", J. Micro/Nanolith. MEMS MOEMS, vol. 11, No. 2, (Apr.-Jun. 2012), pp. 021109-1-021109-9.

(Continued)

*Primary Examiner* — Nicole M Ippolito
(74) *Attorney, Agent, or Firm* — McDermott Will & Emery LLP

(57) ABSTRACT

A method of controlling an excitation laser includes detecting, at a droplet generator, a first signal of radiation scattered by a given target droplet irradiated by a first radiation source at a first position. The method of controlling the excitation laser further includes detecting, at the droplet generator, a second signal of radiation scattered by the given target droplet irradiated by a second radiation source at a second position a fixed distance away from the first position, and determining a speed of the given target droplet based on a time lag between the detecting of the first signal and the detecting of the second signal. The method further includes controlling a trigger time for triggering an excitation pulse for heating the given target droplet based on the determined speed of the given target droplet.

20 Claims, 6 Drawing Sheets

(56) References Cited

U.S. PATENT DOCUMENTS

| | | | | |
|---|---|---|---|---|
| 9,256,123 | B2 | 2/2016 | Shih et al. | |
| 9,529,268 | B2 | 12/2016 | Chang et al. | |
| 9,548,303 | B2 | 1/2017 | Lee et al. | |
| 9,618,837 | B2 | 4/2017 | Lu et al. | |
| 9,869,928 | B2 | 1/2018 | Huang et al. | |
| 9,869,934 | B2 | 1/2018 | Huang et al. | |
| 9,869,939 | B2 | 1/2018 | Yu et al. | |
| 2012/0143152 | A1* | 6/2012 | Hunter | A61B 5/0059 604/298 |
| 2014/0353528 | A1* | 12/2014 | Hayashi | H05G 2/008 250/504 R |
| 2018/0077785 | A1* | 3/2018 | Suzuki | H05G 2/00 |

OTHER PUBLICATIONS

David C. Brandt et al., "LPP Source System Development for HVM", Proc. of SPIE—The International Society for Optical Engineering, Mar. 2010, vol. 7271, pp. 727103-1-727103-10.

* cited by examiner

APPARATUS AND METHOD FOR GENERATING EXTREME ULTRAVIOLET RADIATION

RELATED APPLICATIONS

This application claims priority to U.S. provisional application No. 62/585,778, filed Nov. 14, 2017, the entire contents of which are incorporated herein by reference.

TECHNICAL FIELD

This disclosure relates to methods and apparatus for generating extreme ultraviolet (EUV) radiation, particularly EUV radiation used in semiconductor manufacturing processes.

BACKGROUND

The demand for computational power has increased exponentially. This increase in computational power is met by increasing the functional density, i.e., number of interconnected devices per chip, of semiconductor integrated circuits (ICs). With the increase in functional density, the size of individual devices on the chip has decreased. The decrease in size of components in ICs has been met with advancements in semiconductor manufacturing techniques such as lithography.

For example, the wavelength of radiation used for lithography has decreased from ultraviolet to deep ultraviolet (DUV) and, more recently to extreme ultraviolet (EUV). Further decreases in component size require further improvements in resolution of lithography which are achievable using extreme ultraviolet lithography (EUVL). EUVL employs radiation having a wavelength of about 1-100 nm.

One method for producing EUV radiation is laser-produced plasma (LPP). In an LPP based EUV source a high-power laser beam is focused on small tin droplet targets to form highly ionized plasma that emits EUV radiation with a peak maximum emission at 13.5 nm. The intensity of the EUV radiation produced by LPP depends on the effectiveness with which the high-powered laser can produce the plasma from the droplet targets. Synchronizing the pulses of the high-powered laser with generation and movement of the droplet targets can improve the efficiency of an LPP based EUV radiation source.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1:
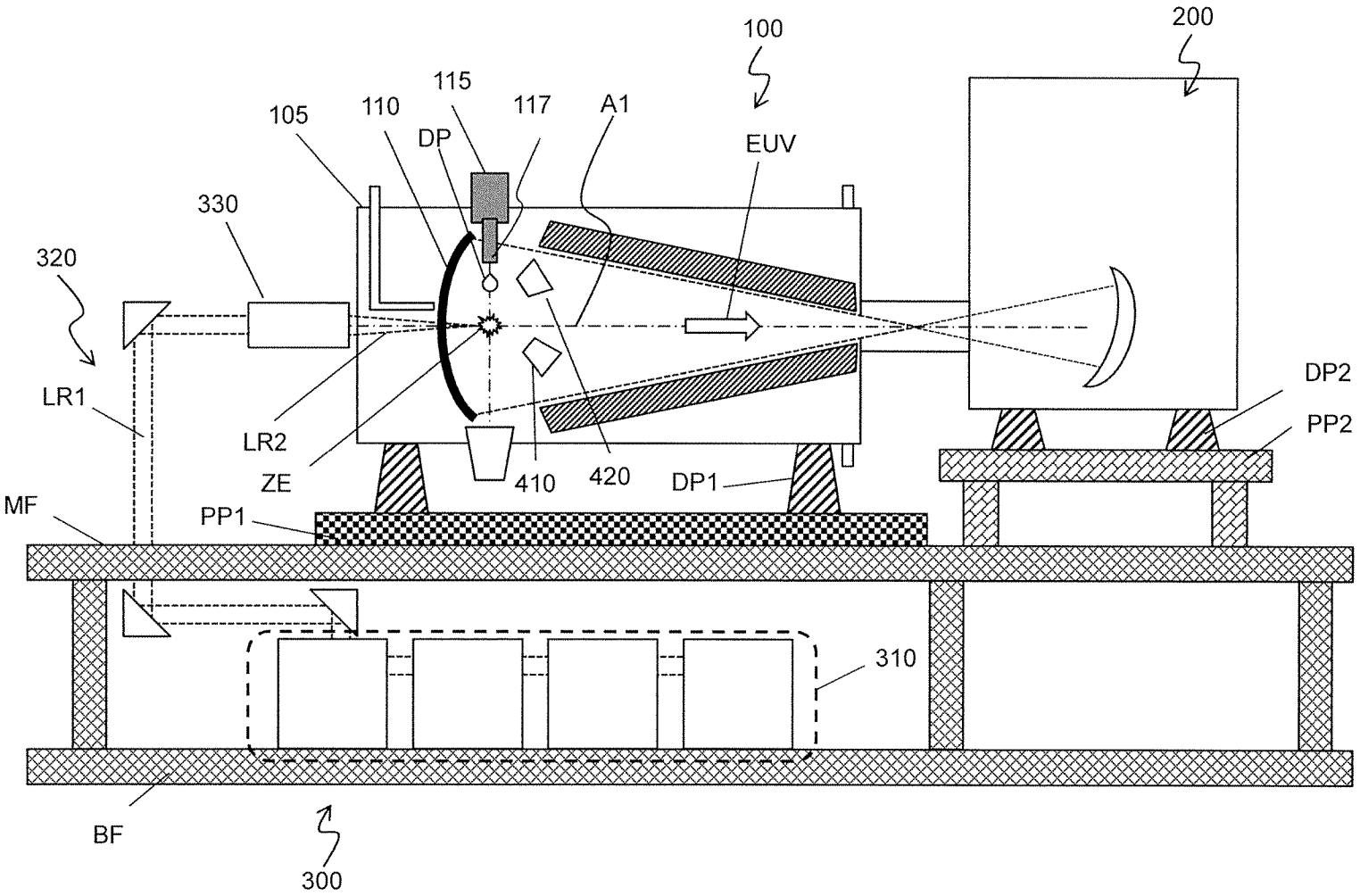
FIG. 1 is a schematic view of an EUV lithography system with a laser production plasma (LPP) EUV radiation source, constructed in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus/device may be otherwise oriented (rotated 90 degrees or at other orientations) and the spatially relative descriptors used herein may likewise be interpreted accordingly. In addition, the term "made of" may mean either "comprising" or "consisting of."

The present disclosure is generally related to extreme ultraviolet (EUV) lithography system and methods. More particularly, it is related to apparatuses and methods for controlling an excitation laser used in a laser produced plasma (LPP) based EUV radiation source. The excitation laser heats metal (e.g., tin) target droplets in the LPP chamber to ionize the droplets to a plasma which emits the EUV radiation. For optimum heating of the target droplets, the target droplets have to arrive at the focal point of the excitation laser at the same time as an excitation pulse from the excitation laser. Thus, synchronization between the target droplets and trigger time for triggering an excitation pulse from the excitation layer contributes to efficiency and stability of the LPP EUV radiation source. One of the objectives of the present disclosure is directed to controlling the excitation laser to provide optimum heating of target droplets.

FIG. 1 is a schematic view of an EUV lithography system with a laser production plasma (LPP) based EUV radiation source, constructed in accordance with some embodiments of the present disclosure. The EUV lithography system includes an EUV radiation source 100 to generate EUV radiation, an exposure tool 200, such as a scanner, and an excitation laser source 300. As shown in FIG. 1, in some embodiments, the EUV radiation source 100 and the exposure tool 200 are installed on a main floor MF of a clean room, while the excitation laser source 300 is installed in a base floor BF located under the main floor. Each of the EUV radiation source 100 and the exposure tool 200 are placed over pedestal plates PP1 and PP2 via dampers DP1 and DP2, respectively. The EUV radiation source 100 and the exposure tool 200 are coupled to each other by a coupling mechanism, which may include a focusing unit.

The lithography system is an extreme ultraviolet (EUV) lithography system designed to expose a resist layer by EUV light (also interchangeably referred to herein as EUV radiation). The resist layer is a material sensitive to the EUV light. The EUV lithography system employs the EUV radiation source 100 to generate EUV light, such as EUV light having a wavelength ranging between about 1 nm and about 100 nm. In one particular example, the EUV radiation source 100 generates an EUV light with a wavelength centered at about 13.5 nm. In the present embodiment, the EUV radiation source 100 utilizes a mechanism of laser-produced plasma (LPP) to generate the EUV radiation.

The exposure tool 200 includes various reflective optic components, such as convex/concave/flat mirrors, a mask holding mechanism including a mask stage, and wafer holding mechanism. The EUV radiation generated by the EUV radiation source 100 is guided by the reflective optical components onto a mask secured on the mask stage. In some embodiments, the mask stage includes an electrostatic chuck (e-chuck) to secure the mask. Because gas molecules absorb EUV light, the lithography system for the EUV lithography patterning is maintained in a vacuum or a-low pressure environment to avoid EUV intensity loss.

In the present disclosure, the terms mask, photomask, and reticle are used interchangeably. In the present embodiment, the mask is a reflective mask. In an embodiment, the mask includes a substrate with a suitable material, such as a low thermal expansion material or fused quartz. In various examples, the material includes $TiO_2$ doped $SiO_2$, or other suitable materials with low thermal expansion. The mask includes multiple reflective multiple layers (ML) deposited on the substrate. The ML includes a plurality of film pairs, such as molybdenum-silicon (Mo/Si) film pairs (e.g., a layer of molybdenum above or below a layer of silicon in each film pair). Alternatively, the ML may include molybdenum-beryllium (Mo/Be) film pairs, or other suitable materials that are configurable to highly reflect the EUV light. The mask may further include a capping layer, such as ruthenium (Ru), disposed on the ML for protection. The mask further includes an absorption layer, such as a tantalum boron nitride (TaBN) layer, deposited over the ML. The absorption layer is patterned to define a layer of an integrated circuit (IC). Alternatively, another reflective layer may be deposited over the ML and is patterned to define a layer of an integrated circuit, thereby forming an EUV phase shift mask.

The exposure tool 200 includes a projection optics module for imaging the pattern of the mask on to a semiconductor substrate with a resist coated thereon secured on a substrate stage of the exposure tool 200. The projection optics module generally includes reflective optics. The EUV radiation (EUV light) directed from the mask, carrying the image of the pattern defined on the mask, is collected by the projection optics module, thereby forming an image on the resist.

In various embodiments of the present disclosure, the semiconductor substrate is a semiconductor wafer, such as a silicon wafer or other type of wafer to be patterned. The semiconductor substrate is coated with a resist layer sensitive to the EUV light in presently disclosed embodiments. Various components including those described above are integrated together and are operable to perform lithography exposing processes.

The lithography system may further include other modules or be integrated with (or be coupled with) other modules.

As shown in FIG. 1, the EUV radiation source 100 includes a target droplet generator 115 and a LPP collector 110, enclosed by a chamber 105. The target droplet generator 115 generates a plurality of target droplets DP, which are supplied into the chamber 105 through a nozzle 117. In some embodiments, the target droplets DP are tin (Sn), lithium (Li), or an alloy of Sn and Li. In some embodiments, the target droplets DP each have a diameter in a range from about 10 microns (μm) to about 100 μm. For example, in an embodiment, the target droplets DP are tin droplets, each having a diameter of about 10 μm, about 25 μm, about 50 μm, or any diameter between these values. In some embodiments, the target droplets DP are supplied through the nozzle 117 at a rate in a range from about 50 droplets per second (i.e., an ejection-frequency of about 50 Hz) to about 50,000 droplets per second (i.e., an ejection-frequency of about 50 kHz). For example, in an embodiment, target droplets DP are supplied at an ejection-frequency of about 50 Hz, about 100 Hz, about 500 Hz, about 1 kHz, about 10 kHz, about 25 kHz, about 50 kHz, or any ejection-frequency between these frequencies. The target droplets DP are ejected through the nozzle 117 and into a zone of excitation ZE at a speed in a range of about 10 meters per second (m/s) to about 100 m/s in various embodiments. For example, in an embodiment, the target droplets DP have a speed of about 10 m/s, about 25 m/s, about 50 m/s, about 75 m/s, about 100 m/s, or at any speed between these speeds.

The excitation laser LR2 generated by the excitation laser source 300 is a pulse laser. The laser pulses LR2 are generated by the excitation laser source 300. The excitation laser source 300 may include a laser generator 310, laser guide optics 320 and a focusing apparatus 330. In some embodiments, the laser source 310 includes a carbon dioxide ($CO_2$) or a neodymium-doped yttrium aluminum garnet (Nd:YAG) laser source with a wavelength in the infrared region of the electromagnetic spectrum. For example, the laser source 310 has a wavelength of 9.4 μm or 10.6 μm, in an embodiment. The laser light LR1 generated by the laser generator 300 is guided by the laser guide optics 320 and focused into the excitation laser LR2 by the focusing apparatus 330, and then introduced into the EUV radiation source 100.

In some embodiments, the excitation laser LR2 includes a pre-heat laser and a main laser. In such embodiments, the pre-heat laser pulse (interchangeably referred to herein as the "pre-pulse) is used to heat (or pre-heat) a given target droplet to create a low-density target plume with multiple smaller droplets, which is subsequently heated (or reheated) by a pulse from the main laser, generating increased emission of EUV light.

In various embodiments, the pre-heat laser pulses have a spot size about 100 μm or less, and the main laser pulses have a spot size in a range of about 150 μm to about 300 μm. In some embodiments, the pre-heat laser and the main laser pulses have a pulse-duration in the range from about 10 ns to about 50 ns, and a pulse-frequency in the range from about 1 kHz to about 100 kHz. In various embodiments, the pre-heat laser and the main laser have an average power in the range from about 1 kilowatt (kW) to about 50 kW. The pulse-frequency of the excitation laser LR2 is matched with the ejection-frequency of the target droplets DP in an embodiment.

The laser light LR2 is directed through windows (or lenses) into the zone of excitation ZE. The windows adopt a suitable material substantially transparent to the laser beams. The generation of the pulse lasers is synchronized with the ejection of the target droplets DP through the nozzle 117. As the target droplets move through the excitation zone, the pre-pulses heat the target droplets and transform them into low-density target plumes. A delay between the pre-pulse and the main pulse is controlled to allow the target plume to form and to expand to an optimal size and geometry. In various embodiments, the pre-pulse and the main pulse have the same pulse-duration and peak power. When the main pulse heats the target plume, a high-temperature plasma is generated. The plasma emits EUV radiation EUV, which is collected by the collector mirror 110. The collector 110 further reflects and focuses the EUV radiation for the lithography exposing processes performed through the exposure tool 200.

One method of synchronizing the generation of a pulse (either or both of the pre-pulse and the main pulse) from the excitation laser with the arrival of the target droplet in the zone of excitation is to detect the passage of a target droplet at given position and use it as a signal for triggering an excitation pulse (or pre-pulse). In this method, if, for example, the time of passage of the target droplet is denoted by $t_o$, the time at which EUV radiation is generated (and detected) is denoted by $t_{rad}$, and the distance between the position at which the passage of the target droplet is detected and a center of the zone of excitation is d, the speed of the target droplet, $v_{dp}$, is calculated as $$v_{dp}=d/(t_{rad}-t_o) \qquad \text{Equation (1).}$$

Because the droplet generator is expected to reproducibly supply droplets at a fixed speed, once $v_{dp}$ is calculated, the excitation pulse is triggered with a time delay of $d/v_{dp}$ after a target droplet is detected to have passed the given position to ensure that the excitation pulse arrives at the same time as the target droplet reaches the center of the zone of excitation. In embodiments where the passage of the target droplet is used to trigger the pre-pulse, the main pulse is triggered following a fixed delay after the pre-pulse. In some embodiments, the value of target droplet speed $v_{dp}$ is periodically recalculated by periodically measuring $t_{rad}$, if needed, and the generation of pulses with the arrival of the target droplets is resynchronized.

Figure 2A:
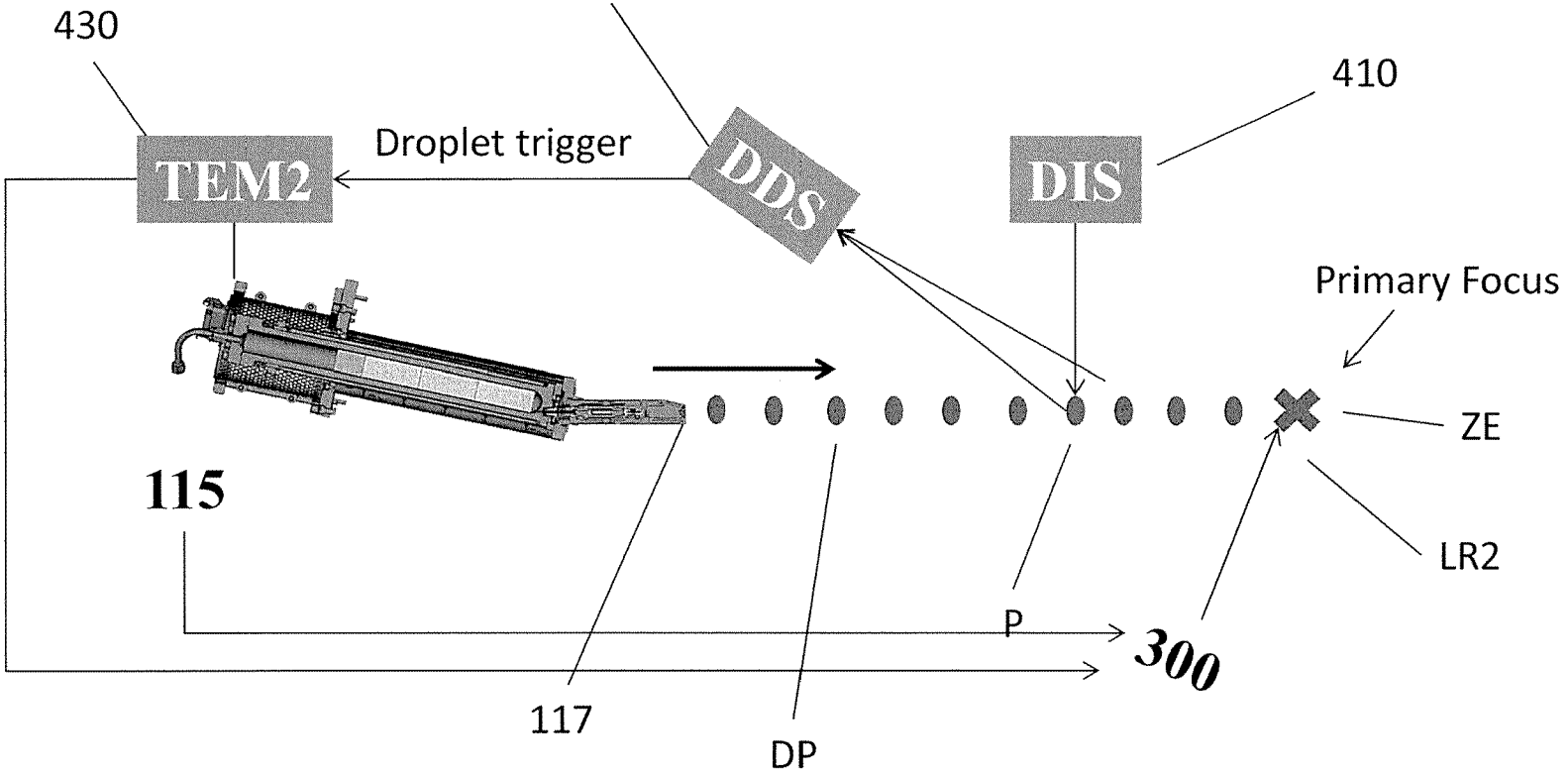
FIG. 2A schematically illustrates a device for synchronizing the generation of excitation pulses with the arrival of the target droplets in the zone of excitation, in accordance with an embodiment.

FIG. 2A schematically illustrates a device for synchronizing the generation of excitation pulses with the arrival of the target droplets in the zone of excitation used in the EUV lithography system illustrated in FIG. 1, in accordance with an embodiment. In an embodiment, a droplet illumination source 410 is used for illuminating a target droplet DP ejected from the nozzle 117. The droplet illumination source 410 is focused at a fixed position P along the path of the target droplet DP from the nozzle 117 to the zone of excitation ZE. One of ordinary skill in the art will appreciate that once the excitation laser hits the target droplet DP within the zone of excitation ZE, the plasma formed because of ionization of the target droplet DP expands rapidly to a volume that is dependent on the size of the target droplet and the energy provided by the excitation laser. In various embodiments, the plasma expands several hundred microns from the zone of excitation ZE. As used herein, the term "expansion volume" refers to a volume to which plasma expands after the target droplets are heated with the excitation laser. Thus, the position P is fixed to be outside the expansion volume to avoid interference from the plasma. In an embodiment, the position P is fixed at a known distance, d, of several millimeters away from the zone of excitation ZE.

The droplet illumination source 410 is a continuous wave laser in an embodiment. In other embodiments, the droplet illumination source 410 is a pulsed laser. The wavelength of the droplet illumination source 410 is not particularly limited. In an embodiment, the droplet illumination source 410 has a wavelength in the visible region of electromagnetic spectrum. In various embodiments, the droplet illumination source 410 has an average power in the range from about 1 W to about 50 W. For example, in an embodiment, the droplet illumination source 410 has an average power of about 1 W, about 5 W, about 10 W, about 25 W, about 40 W, about 50 W, or any average power between these values. In some embodiments, the droplet illumination source 410 generates a beam having a uniform illumination profile. For example, in an embodiment, the droplet illumination source 410 creates a fan-shaped light curtain having substantially the same intensity across its profile. The beam produced by the droplet illumination source 410 has a width of in the range of about 10 μm to about 300 μm in various embodiments.

As the target droplet DP passes through the beam generated by the droplet illumination source 410, the target droplet DP scatters the photons in the beam. In an embodiment, the target droplet DP produces a substantially Gaussian intensity profile of scattered photons. The photons scattered by the target droplet DP are detected by a droplet detection sensor 420 (interchangeably referred to herein as "droplet detector 420"). Without wishing to be bound by theory, the center of the target droplet DP corresponds to the peak of the intensity profile detected at the droplet detection sensor 420. In some embodiments, the droplet detection sensor 420 is a photodiode and generates an electrical signal upon detecting the photons scattered by the target droplet DP. Thus, the droplet detection sensor 420 detects when a target droplet has passed position P.

The time, $t_o$, at which the droplet detection sensor 420 detects the target droplet DP passing the position P is provided to a timing and energy measurement module 430. Once the target droplet reaches the zone of excitation ZE and is heated with an excitation laser pulse LR2, the material of the target droplet is ionized into plasma, which emits EUV radiation EUV. This EUV radiation is detected by the timing and energy measurement module 430.

In an embodiment, the timing and energy measurement module 430 includes a detector configured to detect the EUV power generated at each instance of plasma generation. The detector includes a photodiode or a filtered photodiode configured to convert the energy from photons incident on it into an electrical signal in some embodiments. In an embodiment, the detector also includes a mirror that reflects the EUV radiation from a fixed position in the exposure tool on to the photodiode.

The timing and energy measurement module 430, in an embodiment, is configured to estimate the time at which the power of the EUV radiation peaks, $t_{rad}$. Speed of the target droplet, calculated using Equation (1), is then used to trigger the excitation pulse for a subsequent target droplet. Those of skill in the art would appreciate that in order to estimate the time at which EUV power peaks, it is not necessary to measure the absolute power EUV power generated at every instance of plasma generation, but the rate of change of EUV power is sufficient to estimate the precise time at which the EUV power peaks.

Speed of a target droplet is calculated based on a peak in the EUV energy, and this measurement of speed is used to trigger an excitation pulse for the next target droplet. In an embodiment, the timing and energy measurement module 430 is further configured to calculate, using Equation (1), the precise time at which the next target droplet will arrive at the zone of excitation ZE, and provide a trigger signal to the excitation laser source 300 to control the trigger time for the excitation pulse LR2.

Inherent in this method of triggering the excitation pulses are several assumptions. One assumption is that the speed of the target droplets DP supplied from the nozzle is substantially the same. Another assumption in this calculation is that the speed of the target droplets remains substantially the same as they travel from the nozzle to the zone of excitation. Yet another assumption is that the excitation laser is perfectly stable and that each pulse is identical in duration and energy to its preceding pulse. A further assumption is the energy profile the EUV radiation emitted by the plasma remains substantially the same for every excitation pulse. However, for a given target droplet, one or more of these assumptions may not be true.

In some embodiments, even one of these assumptions being false results in sub-optimal performance of the EUV radiation source 100. Obviously, the deviation from optimal performance because of failure of one of the assumptions depends on which of the assumptions was false.

Figure 2B:
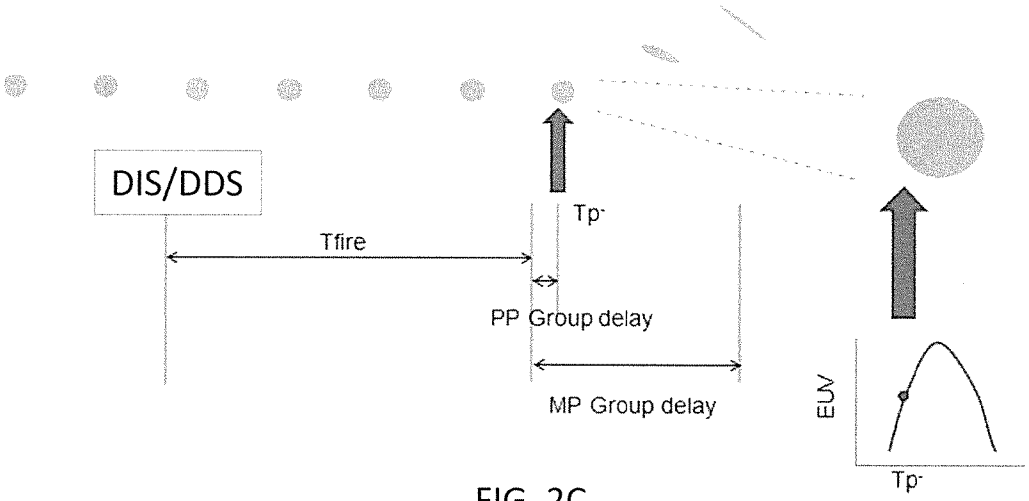
FIGS. 2B and 2C schematically illustrate the result of an incorrectly timed pre-pulse of the excitation laser.
Figure 2C:
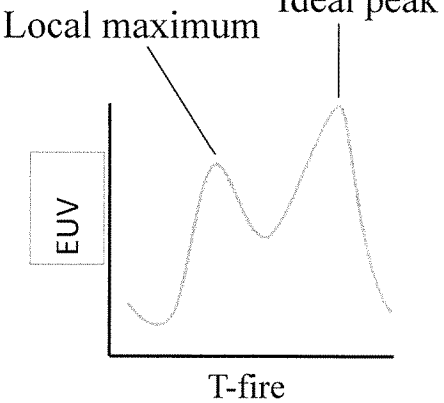

FIGS. 2B and 2C schematically illustrate the result of an incorrectly timed pre-pulse of the excitation laser. As seen in FIG. 2B, if a target droplet is traveling faster (or slower) than the speed calculated based on detection of peak of the EUV energy generated by the immediately preceding target droplet, the pre-pulse arrives later (or earlier) than the target droplet, resulting in sub-optimal pre-heating of the target droplet. In such situation, even if the main pulse arrives at the same time as the target droplet, because the target droplet at the focal point of the main pulse has a smaller than optimal diameter, the expansion volume of the resulting plasma expands is smaller. The smaller expansion volume results in a lower EUV energy peak. This second lower EUV energy peak is illustrated in FIG. 2C as the local maximum, in addition to the ideal peak (global maximum) which would result from a pre-pulse (and a main pulse) that is perfectly synchronized with the arrival of the target droplet. As can be seen in FIG. 2B, the function has a single peak when the pre-pulse and target droplet are perfectly synchronized to arrive at the zone of excitation. In such ideal instances, the time at which the EUV energy peaks is used to calculate the timing of the subsequent pre-pulse.

FIG. 2C represents the variation of EUV energy as a function of time at which the pre-pulse arrives at the zone of excitation. Because measured EUV energy is used to calculate the time for the subsequent pre-pulse, the EUV energy generated when a target droplet (i.e., the center of the target droplet) arrives before or after the pre-pulse at the zone of excitation is lower than the maximum EUV energy possible (in the ideal situation), and is registered as the first (lower) peak in FIG. 2C. When such lower than maximum EUV energy is measured and used to determine the timing of the next pre-pulse, it is likely that a subsequent target droplet may actually generate higher EUV energy if it does not arrive at the correct calculated time, resulting in a second (higher) peak in EUV energy as illustrated in FIG. 2C. In instances where two such peaks are registered, the control loop that calculates the pre-pulse timing based on peak EUV energy is disrupted.

It is contemplated that, elimination of at least some of these assumptions should reduce the probability of deviation from optimal performance of the EUV radiation source.

Figure 3:
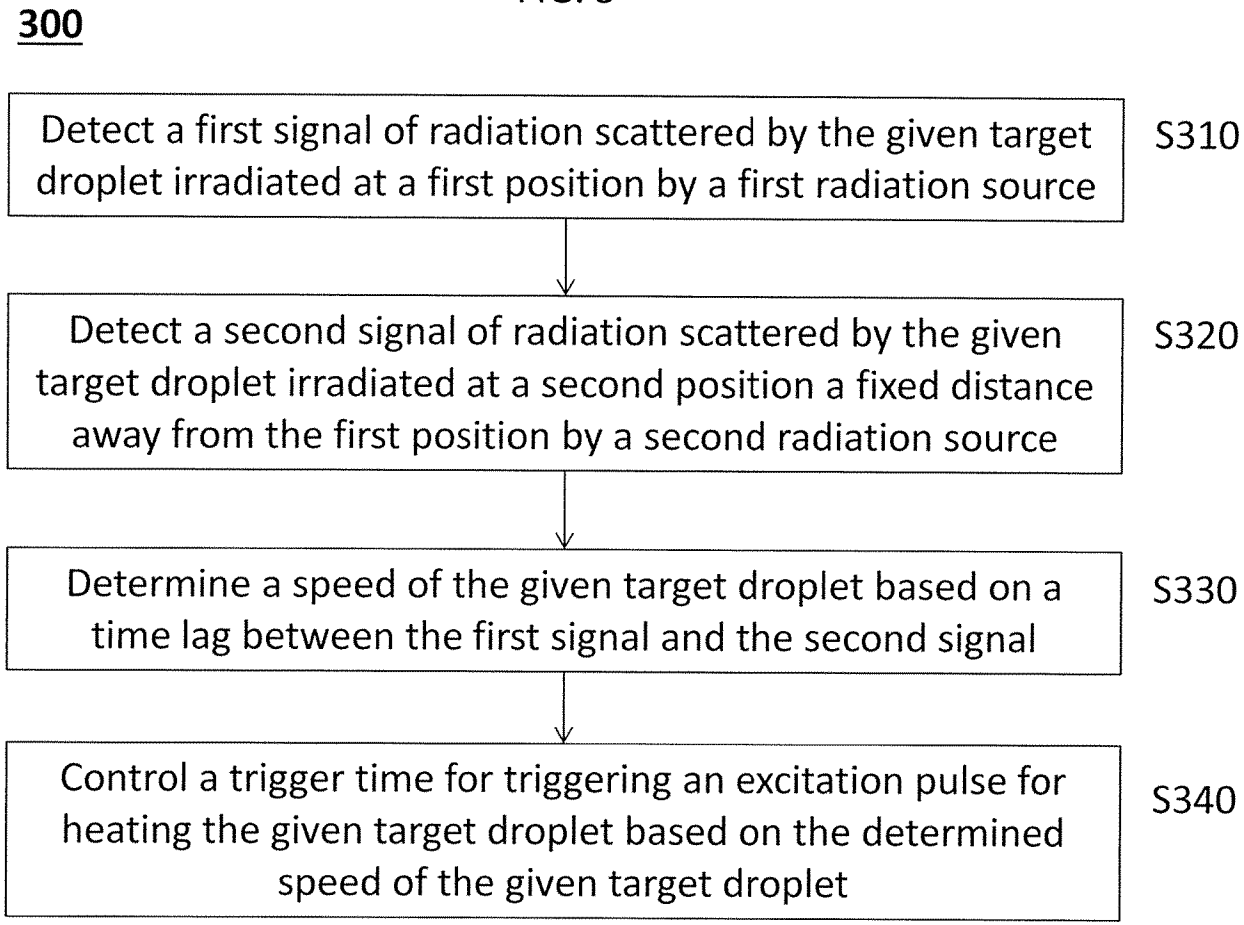
FIG. 3 illustrates a flow-chart of a method of controlling an excitation laser for an EUV radiation source in accordance with an embodiment of the present disclosure.

FIG. 3 illustrates a flow-chart of a method of controlling an excitation laser for an EUV radiation source, in accordance with an embodiment of the present disclosure. In an embodiment, the method 300 includes, at S310, detecting a first signal of radiation scattered by a given target droplet irradiated by a first radiation source at a first position, and at S320, detecting a second signal of radiation scattered by the given target droplet irradiated by a second radiation source at a second position a fixed distance away from the first position. The method 300 further includes, at S330, determining a speed of the given target droplet based on a time lag between the detecting of the first signal and the detecting of the second signal, and at S340, controlling a trigger time for triggering an excitation pulse for heating the given target droplet based on the determined speed of the given target droplet.

In an embodiment, both the first and the second radiation sources are continuous wave lasers having an average power in a range of about 1 W to about 50 W. For example, in an embodiment, the first radiation source and the second radiation source, each has an average power of about 1 W, about 5 W, about 10 W, about 25 W, about 40 W, about 50 W, or any average power between these values. In some embodiments, the first radiation source and the second radiation source have different average powers. For example, in an embodiment, the first radiation source is a continuous wave laser with an average power of about 10 W and the second radiation source is a continuous wave laser with an average power of about 35 W. In other embodiments, the first and the second radiation sources are pulse lasers with relatively low peak power.

The first radiation source and the second radiation source have a wavelength in the visible spectrum of electromagnetic radiation in some embodiments. The wavelength of the first radiation source is the same as or different from the wavelength of the second radiation source in some embodiments.

In various embodiments, each of the first and the second radiation sources generates a beam having a uniform illumination profile. For example, in an embodiment, the first radiation source and the second radiation source create a fan-shaped light curtain having substantially the same intensity across its profile.

In an embodiment, the first radiation source is focused at a first position along the path of the target droplet from the nozzle of the droplet generator to the zone of excitation zone and the second radiation source is focused at a second position along the path of the target droplet from the nozzle to the zone of excitation. In other words, a given target droplet passes the first position and the second position as it travels from the nozzle to the zone of excitation. The first position and the second position are a fixed distance, d', away along the path of travel of the target droplet. In an embodiment, the fixed distance, d', between the first position and the second position is in a range of about 2 to about 10 times the distance between successive target droplets. Without wishing to be bound by theory, an optimum distance between successive target droplets depends on the expansion volume of the plasma produced by the individual target droplets which in turn depends on the size of the individual target droplets. For example, in an embodiment, an optimum distance between successive target droplets having a diameter of about 30 μm is greater than about 1 mm. Thus, in various embodiments, the fixed distance, d', between the first and the second position is in a range from about 1 mm to about 20 mm depending on the size of the individual target droplets.

As the target droplet passes through the beam generated by the first radiation source, the target droplet scatters the photons in the beam of the first radiation source at the first position. The signal provided by the photons scattered at the first position is detected at a droplet detection sensor (interchangeably referred to herein as "droplet detector"). As discussed elsewhere herein, in an embodiment, a target droplet passing through the beam generated by the first radiation source produces, for example, a substantially Gaussian intensity profile of scattered photons. In such an embodiment, the center of the target droplet corresponds to the peak of the intensity profile produced at the first position. This peak is detected at the droplet detection sensor, say, at a time $t_1$. Similarly, as the target droplet passes the second position, the peak of the intensity profile produced at the second position is detected at the droplet detection sensor, say, at a time $t_2$. Because the distance, d', between the first and the second positions is known, the speed of the target droplet is calculated as:

$$v_{dp}=d'/(t_2-t_1) \quad \text{Equation (2).}$$

Because the distance between either of the first and the second positions from the zone of excitation is known, the time needed for the target droplet to arrive at the zone of excitation can be readily calculated using the speed of the target droplet calculated using Equation (2). Thus, in some embodiments, the trigger time for triggering an excitation pulse (the pre-pulse or the main pulse) is controlled such that the excitation pulse is triggered at the same time as the estimated arrival of the target droplet in the zone of excitation.

One of ordinary skill in the art will appreciate that because plasma exerts pressure, the momentum of the target droplet traveling towards the zone of excitation may be reduced as the target droplet approaches the expansion volume of the plasma. In some cases, this may reduce the speed of the target droplet slightly, causing the target droplet to arrive slightly later than the arrival time estimated using the speed calculated by Equation (2). This difference between the actual and estimated time of arrival of the target droplet in the zone of excitation can be calculated using the time of the EUV energy peak discussed elsewhere herein. Thus, in an embodiment, the method 300 further includes determining a trigger time for a preceding excitation pulse based on detection of the EUV energy peak generated by the plasma of the preceding target droplet, and calculating the difference between the optimal time of arrival of the target droplet and the time of arrival estimated using Equation (2). The trigger time for triggering the excitation pulse is, then, further adjusted using this difference in timing of arrival of the target droplet in the zone of excitation.

Figure 4A:
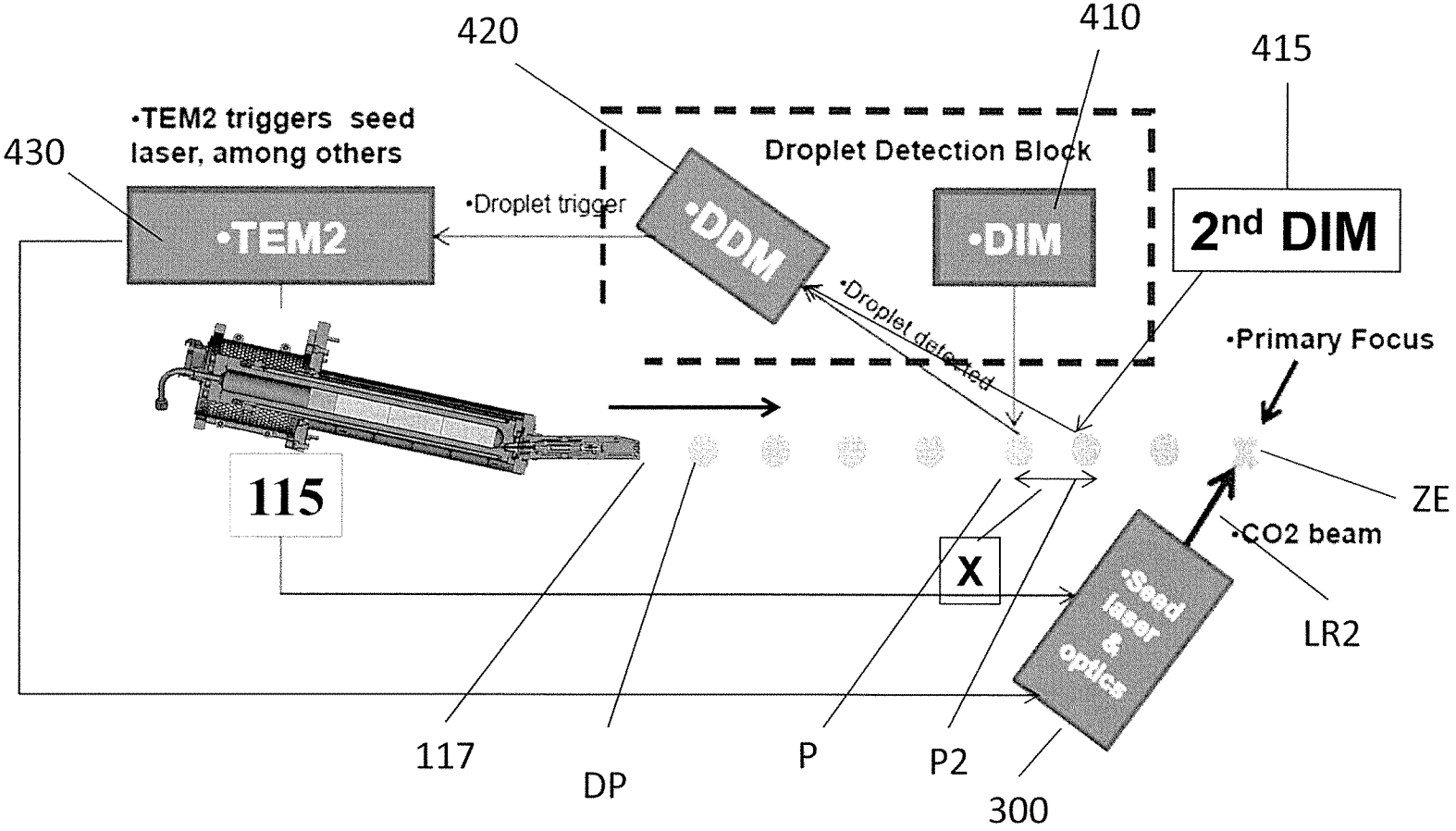
FIG. 4A schematically illustrates a device for controlling an excitation laser in an EUV radiation source in accordance with an embodiment of the present disclosure.

FIG. 4A schematically illustrates a device for controlling an excitation laser in an EUV radiation source, in accordance with an embodiment of the present disclosure. In an embodiment, the device is generally the same as that shown in FIG. 2A with the exception of an additional second radiation source 415. Description of the parts that are substantially the same is, therefore, omitted in interest of brevity, while a description of differences between the device of FIG. 2A and the device of FIG. 4A follows. Additionally, for convenience of description, the droplet illumination source 410 of FIG. 2A is referred to as the first radiation source 410 for the purposes of FIG. 4A. However, the essential characteristics of the droplet illumination source 410 and the first radiation source 410 remain the same and a description thereof is omitted in interest of brevity.

The second radiation source 415 is a continuous wave laser in an embodiment. While the wavelength of the droplet illumination source 415 is not particularly limited, in an embodiment, the wavelength of the second radiation source 415 is different from the wavelength of the first radiation source 410. In another embodiment, the wavelength of the first radiation source 410 and the second radiation source 415 is the same. In various embodiments, the second radiation source 415 has an average power in the range from about 1 W to about 50 W. For example, in an embodiment, the second radiation source 415 has an average power of about 1 W, about 5 W, about 10 W, about 25 W, about 40 W, about 50 W, or any average power between these values. However, in an embodiment, the average power of the second radiation source 415 is different from the average power of the first radiation source 410. In some embodiments, the second radiation source 415 generates a beam having a uniform illumination profile. For example, in an embodiment, the second radiation source 415 creates a fan-shaped light curtain having substantially the same intensity across its profile.

In an embodiment, the light beam from the first radiation source 410 is focused at a first position P along the path of the target droplet DP from the nozzle 117 to the zone of excitation ZE, and the light beam from the second radiation source 415 is focused at a second position P2 a fixed distance away from the first position P along the path of the target droplet DP from the nozzle 117 to the zone of excitation ZE. The distance, d', between the first position P and the second position P2 is in a range of about 2 to about 10 times the distance between successive target droplets. In various embodiments, the fixed distance, d', between the first position P and the second position P2 is in a range from about 1 mm to about 20 mm depending on the size of the individual target droplets.

As the target droplet DP travels from the nozzle 117 to the zone of excitation ZE, it passes the first position P, where it is illuminated (or irradiated) by the first radiation source 410, and the second position P2, where it is illuminated (or irradiated) by the second radiation source 415. Photons scattered by the target droplet DP at each of the first position P and the second position P2 are detected at a droplet detector 420. The droplet detector 420 is a photodiode in an embodiment. A time, $t_1$, at which the target droplet DP passes the first position P and a time, $t_2$, at which the target droplet DP passes the second position P2 are used to calculate the speed, $v_{dp}$, of the target droplet DP using Equation (2).

The target droplet speed $v_{dp}$ is used to estimate a time of arrival of the target droplet DP at the zone of excitation ZE, and an excitation pulse (a pre-pulse or a main pulse) is triggered to arrive at the zone of excitation ZE at the same time as the target droplet DP.

Because the speed of a target droplet is used to estimate its own time of arrival at the zone of excitation, the synchronization between the arrival of the target droplet and the excitation pulse is improved. However, as discussed elsewhere herein, pressure exerted by the high-temperature plasma from a preceding target droplet may reduce the speed of the target droplet slightly and result in a slight error in synchronization. In an embodiment, such an error in synchronization can be corrected using information about the EUV energy generated by the plasma from the preceding target droplet. For example, in an embodiment, a timing and energy measurement module 430 measures the EUV energy generated as a function of time. One of ordinary skill in the art will appreciate that the EUV energy peak is reached at measurable time after the excitation pulse is triggered. However, if the EUV energy peak is reached at a time later than an expected time, there may be an error in synchronization of the arrival of the target droplet and the excitation pulse. Thus, in an embodiment, a time difference between the triggering of the excitation pulse and the EUV energy peak is used to further correct the synchronization (if needed) of the arrival of the target droplet and the excitation pulse.

Figure 4B:
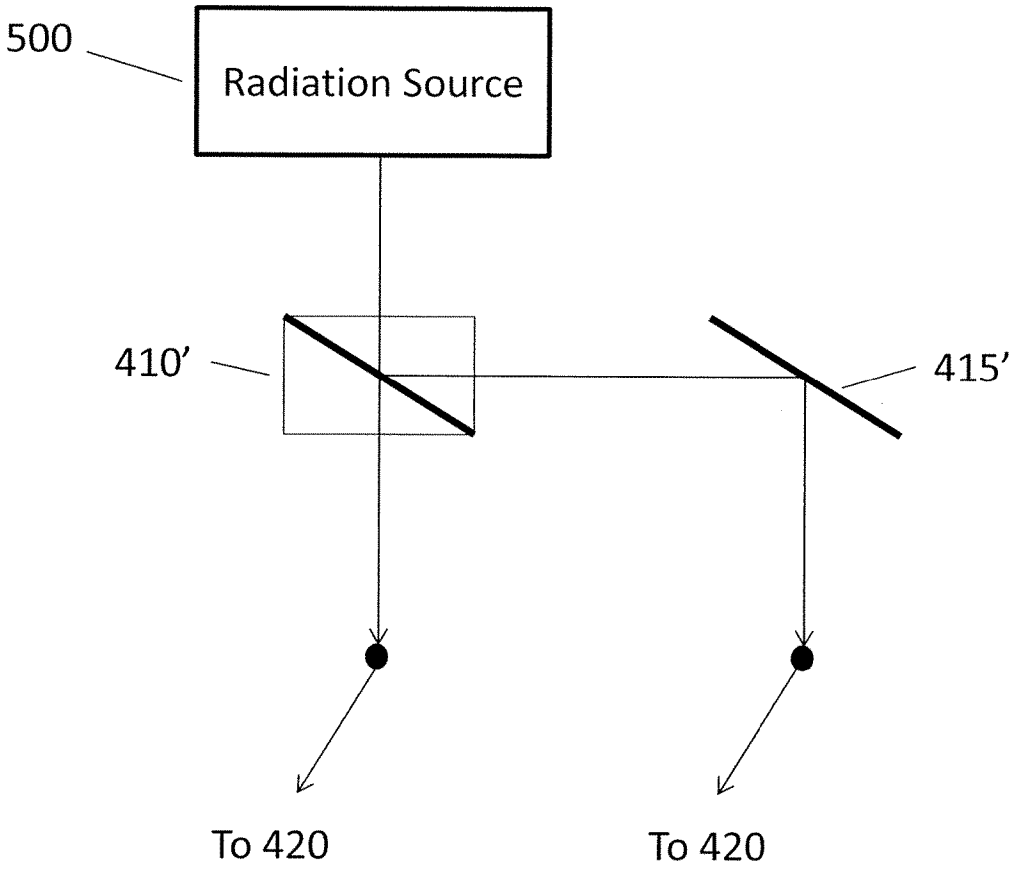
FIG. 4B schematically illustrates an alternate embodiment of the second radiation source in the device for controlling an excitation laser in an EUV radiation source of FIG. 4A in accordance with an embodiment of the present disclosure.

FIG. 4B schematically illustrates an alternate embodiment of the second radiation source in the device for controlling an excitation laser in an EUV radiation source of FIG. 4A, in accordance with an embodiment of the present disclosure. In some embodiments, the first radiation source 410' and the second radiation source 415' are virtual radiation sources. For example, in an embodiment, the first radiation source 410' and the second radiation source 415' are mirrors which separately reflect light from a radiation source 500. In an embodiment, a beam-splitter which reflects a portion of the light received from radiation source 500 forms the first radiation source 410'. The portion of light transmitted by the beam-splitter is then reflected from a mirror which forms the second radiation source 415'. The beam-splitter 410' can be chosen to have a particular transmittance to distinguish the intensities of light coming from the first radiation source 410' and the second radiation source 415' in some embodiments. In some embodiments, the second radiation source 415' is also a partially reflecting mirror which reflects only a portion of light it receives to help distinguish the intensities of light coming from the first radiation source 410' and the second radiation source 415'.

It is contemplated that additional radiation sources for measuring the speed of target droplets can be added, if necessary, for improving the accuracy of measured speed, for example, to account for deceleration of the target droplets DP as they move through the chamber 105. Likewise, while the embodiments disclose a single droplet detector 420, those of skill the art will appreciate that separate droplet detectors 420 for each of the radiation source 410 and 415 may be used; however, using such separate detectors comes at the cost of additional synchronization to ensure that the time lag between the first signal and the second signal is measured accurately.

In the present disclosure, by measuring a velocity of target droplets by irradiating the target droplets at two different positions a fixed distance away from each other and measuring a time lag between the light signals from the two different positions, it is possible to improve the synchronization between excitation pulses from the high-powered laser and the target droplets. Thus, it is possible to improve the efficiency of an LPP based EUV source.

It will be understood that not all advantages have been necessarily discussed herein, no particular advantage is required for all embodiments or examples, and other embodiments or examples may offer different advantages.

According to one aspect of the present disclosure, an extreme ultraviolet (EUV) radiation source includes a droplet generator configured to generate target droplets and an excitation laser configured to heat the target droplets using excitation pulses. The EUV radiation source further includes a device for controlling the excitation laser includes a first radiation source, a second radiation source and a droplet detector operatively coupled with the excitation layer. The first radiation source is configured to irradiate each of the target droplets at a first position. The second radiation source is configured to irradiate each of the target droplets at a second position a fixed distance away from the first position. The droplet detector is configured to detect a first signal of radiation scattered by a given target droplet at the first position and a second signal of radiation scattered by the given target droplet at the second position, and measure a speed of the given target droplet. A trigger time for providing an excitation pulse to heat the given target droplet is based on the measured speed of the given target droplet. In one or more of the foregoing or following embodiments, the first radiation source and the second radiation source include lasers having the same wavelength. In an embodiment, the fixed distance is in the range from about 2 to about 10 times a distance between successive target droplets generated by the target droplet generator. In an embodiment, the first radiation source and the second radiation source include continuous wave lasers with an average power in the range of about 10 W to about 50 W. In some embodiments, the speed of the given target droplet is measured based on a time lag between detection of the first signal and detection of the second signal at the droplet detector. In some embodiments, the device further includes an energy detector operatively coupled to the excitation laser. The energy detector configured to measure a trigger time of a preceding excitation pulse heating a target droplet preceding the given target droplet based on detection of EUV radiation generated by the heating of the preceding target droplet. In an embodiment, the trigger time for providing the excitation pulse to heat the given target droplet is further based on the measured trigger time of the preceding excitation pulse.

According to another aspect of the present disclosure, a method of controlling an excitation laser including an extreme ultraviolet (EUV) radiation source including a droplet generator configured to generate target droplets and the excitation laser configured to heat the target droplets using excitation pulses, detecting, at a droplet generator, a first signal of radiation scattered by a given target droplet irradiated by a first radiation source at a first position. The method of controlling the excitation laser further includes detecting, at the droplet generator, a second signal of radiation scattered by the given target droplet irradiated by a second radiation source at a second position a fixed distance away from the first position, and determining a speed of the given target droplet based on a time lag between the detecting of the first signal and the detecting of the second signal. The method further includes controlling a trigger time for triggering an excitation pulse for heating the given target droplet based on the determined speed of the given target droplet. In one or more of the foregoing and following embodiments, the method further includes determining a trigger time for a preceding excitation pulse heating a target droplet preceding the given target droplet based on detection of EUV radiation generated by heating of the preceding target droplet and controlling the trigger time for triggering the excitation pulse to heat the given target droplet based on the measured trigger time of the preceding excitation pulse and the determined speed of the given target droplet. In some embodiments, the first radiation source and the second radiation source include lasers having a same wavelength. In some embodiments, the fixed distance is in a range from 2 to 10 times a distance between successive target droplets generated by the droplet generator. In some embodiments, the first radiation source and the second radiation source include continuous wave lasers with an average power in a range from about 10 W to about 50 W.

According to yet another aspect of the present disclosure, an apparatus for generating extreme ultraviolet (EUV) radiation includes a droplet generator, an excitation laser, a first radiation source, a second radiation source, and a droplet detector operatively coupled to the excitation laser. The droplet generator is configured to generate target droplets. The excitation laser is configured to heat the target droplets using excitation pulses. The first radiation source is configured to irradiate the target droplets at a first position. The second radiation source is configured to irradiate the target droplets at a second position, the second position being a fixed distance away from the first position. The droplet detector is configured to detect a first signal of radiation scattered by a given target droplet at the first position and a second signal of radiation scattered by the given target droplet at the second position. A trigger time for triggering an excitation pulse for heating the given target droplet is determined based on a time lag between the first signal and the second signal, and an EUV pulse is generated by heating each of the target droplets. In one or more of the foregoing and following embodiments, the apparatus further includes an energy detector operatively coupled with the excitation laser. The energy detector is configured to measure a trigger time of a preceding excitation pulse heating a target droplet preceding the given target droplet based on detection of the EUV pulse generated by the heating of the preceding target droplet. In an embodiment, the trigger time for triggering the excitation pulse for heating the given target droplet is determined based on the measured trigger time of the preceding excitation pulse. In some embodiments, the first radiation source and the second radiation source include lasers having a same wavelength. In an embodiment, the fixed distance ranges from 2 to 10 times a distance between successive target droplets generated by the droplet generator. In some embodiments, the first radiation source and the second radiation source include lasers having different average power.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A device for controlling an excitation laser in an extreme ultraviolet (EUV) radiation source, the EUV radiation source comprising a droplet generator configured to generate target droplets and the excitation laser configured to heat the target droplets using excitation pulses, the device comprising:

a first radiation source configured to irradiate each of the target droplets at a first position;

a second radiation source configured to irradiate each of the target droplets at a second position a fixed distance away from the first position;

a droplet detector configured to detect a first signal of radiation scattered by a given target droplet at the first position and a second signal of radiation scattered by the given target droplet at the second position; and a timing module configured to receive the first signal and the second signal, measure a speed of the given target droplet based on the received signals, estimate a trigger time for providing an excitation pulse to heat the given target droplet based on the measured speed and provide the excitation laser the trigger time.

2. The device of claim 1, wherein the first radiation source and the second radiation source comprise lasers having a same wavelength.

3. The device of claim 1, wherein the fixed distance is in a range from about 2 to about 10 times a distance between successive target droplets generated by the droplet generator.

4. The device of claim 1, wherein the first radiation source and the second radiation source comprise lasers having different average power.

5. The device of claim 1, wherein the first radiation source and the second radiation source comprise continuous wave lasers with an average power in a range from about 10 W to about 50 W.

6. The device of claim 1, wherein the speed of the given target droplet is measured based on a time lag between detection of the first signal and detection of the second signal at the droplet detector.

7. The device of claim 1, further comprising an energy detector configured to measure a trigger time of a preceding excitation pulse heating a target droplet preceding the given target droplet based on a detection of energy of the EUV radiation generated by the heating of the preceding target droplet.

8. The device of claim 7, wherein the timing module is configured to estimate the trigger time further based on the measured trigger time of the preceding excitation pulse.

9. A method of controlling an excitation laser in an extreme ultraviolet (EUV) radiation source comprising a droplet generator configured to generate target droplets and the excitation laser configured to heat the target droplets using excitation pulses, the method comprising:

detecting, at a droplet detector, a first signal of radiation scattered by a given target droplet irradiated by a first radiation source at a first position;

detecting, at the droplet detector, a second signal of radiation scattered by the given target droplet irradiated by a second radiation source at a second position a fixed distance away from the first position;

determining a speed of the given target droplet based on a time lag between the detecting of the first signal and the detecting of the second signal; and controlling a trigger time for triggering an excitation pulse for heating the given target droplet based on the determined speed of the given target droplet.

10. The method of claim 9, further comprising determining a trigger time for a preceding excitation pulse heating a target droplet preceding the given target droplet based on detection of EUV radiation generated by the heating of the preceding target droplet; and controlling the trigger time for triggering the excitation pulse to heat the given target droplet based on the measured trigger time of the preceding excitation pulse and the determined speed of the given target droplet.

11. The method of claim 9, wherein the first radiation source and the second radiation source comprise lasers having a same wavelength.

12. The method of claim 9, wherein the fixed distance is in a range from 2 to 10 times a distance between successive target droplets generated by the droplet generator.

13. The method of claim 9, wherein the first radiation source and the second radiation source comprise lasers having different average power.

14. The method of claim 9, wherein the first radiation source and the second radiation source comprise continuous wave lasers with an average power in a range from about 10 W to about 50 W.

15. An apparatus for generating extreme ultraviolet (EUV) radiation, the apparatus comprising:

a droplet generator configured to generate target droplets;

an excitation laser configured to heat the target droplets using excitation pulses;

a first radiation source configured to irradiate the target droplets at a first position;

a second radiation source configured to irradiate the target droplets at a second position, the second position being a fixed distance away from the first position;

a droplet detector configured to detect a first signal of radiation scattered by a given target droplet at the first position and a second signal of radiation scattered by the given target droplet at the second position, and a timing module configured to receive the first signal and the second signal, estimate a trigger time for providing an excitation pulse to heat the given target droplet based on a time lag between the first signal and the second signal and provide the excitation laser the trigger time, wherein an EUV radiation pulse is generated by heating each of the target droplets.

16. The apparatus of claim 15, further comprising:

an energy detector configured to measure a trigger time of a preceding excitation pulse heating a target droplet preceding the given target droplet based on detection of the EUV pulse generated by the heating of the preceding target droplet.

17. The apparatus of claim 16, wherein the timing module is configured to estimate the trigger time further based on the measured trigger time of the preceding excitation pulse.

18. The apparatus of claim 15, wherein the first radiation source and the second radiation source comprise lasers having a same wavelength.

19. The apparatus of claim 15, wherein the fixed distance ranges from 2 to 10 times a distance between successive target droplets generated by the droplet generator.

20. The apparatus of claim 15, wherein the first radiation source and the second radiation source comprise lasers having different average power.

* * * * *